US006558238B1

(12) United States Patent
Crevasse et al.

(10) Patent No.: US 6,558,238 B1
(45) Date of Patent: May 6, 2003

(54) APPARATUS AND METHOD FOR RECLAMATION OF USED POLISHING SLURRY

(75) Inventors: Annette M. Crevasse, Apopka, FL (US); William G. Easter, Orlando, FL (US); John A. Maze, Clermont, FL (US); Frank Miceli, Orlando, FL (US)

(73) Assignee: Agere Systems Inc., Allentown, PA (US)

( * ) Notice: Subject to any disclaimer, the term of this patent is extended or adjusted under 35 U.S.C. 154(b) by 16 days.

(21) Appl. No.: 09/665,279

(22) Filed: Sep. 19, 2000

(51) Int. Cl.[7] ..... B24B 55/04
(52) U.S. Cl. ..... 451/287; 451/446; 451/453
(58) Field of Search ..... 451/87, 285, 287, 451/88, 446, 453, 36, 282, 60

(56) References Cited

U.S. PATENT DOCUMENTS 4,162,760 A 7/1979 Hill
5,458,776 A 10/1995 Preisser et al.
5,462,513 A 10/1995 McAlister
5,755,614 A * 5/1998 Adams et al. ..... 134/902
5,791,970 A * 8/1998 Yueh ..... 451/446
5,827,114 A * 10/1998 Yam et al. ..... 451/40
5,919,124 A 7/1999 Corlett et al.
5,975,991 A * 11/1999 Karlsrud ..... 451/287
6,056,631 A * 5/2000 Brown et al. ..... 451/288
6,106,728 A * 8/2000 Iida et al. ..... 210/167
6,126,531 A * 10/2000 Iida et al. ..... 451/447
6,156,659 A * 12/2000 Roy ..... 438/692
6,183,352 B1 * 2/2001 Kurisawa ..... 210/107
6,190,236 B1 * 2/2001 Drill ..... 451/285
6,203,412 B1 * 3/2001 Quek ..... 451/285
6,291,350 B1 * 9/2001 Hashimoto et al. ..... 438/692
6,413,151 B2 * 7/2002 Mizuno et al. ..... 451/285

* cited by examiner

*Primary Examiner*—Eileen P. Morgan
*Assistant Examiner*—Hadi Shakeri

(57) ABSTRACT

The present invention provides a polishing slurry reclamation system. In one embodiment, the polishing slurry reclamation system comprises a polishing apparatus having a polishing platen and a fluid delivery system positioned to deliver a slurry or a rinse to the polishing platen, a recovery drain adjacent the polishing platen, and a fluid diverter associated with the platen and configured to deflect a selected one of a slurry or rinse emanating from the polishing platen to the recovery drain.

7 Claims, 5 Drawing Sheets

APPARATUS AND METHOD FOR RECLAMATION OF USED POLISHING SLURRY

TECHNICAL FIELD OF THE INVENTION

The present invention is directed, in general, to semiconductor wafer processing and, more specifically, to an apparatus and method for reclamation and recycling of CMP (chemical/mechanical planarization) slurries.

BACKGROUND OF THE INVENTION

In the manufacture of integrated circuits (ICs), chemical/mechanical polishing (CMP) is used to provide smooth topographies of semiconductor wafer substrates, on which the ICs are formed, for subsequent lithography and material deposition. These CMP processes are well known within the IC fabrication industry.

One major problem associated with this process involves post-CMP handling of the polishing slurry. It is well known that a large percentage, perhaps as much as 75 percent to 85 percent, of the slurry is never fully utilized during semiconductor wafer planarization. Because of the physical constraints of the polishing apparatus, the slurry that actually performs the planarization, i.e., "used" slurry, is commingled with the slurry that is excess to the process needs, i.e., "unused" slurry. Therefore, while not directly separable from the "used" slurry, the "unused" slurry is carried off into the waste slurry drain. As such, the "waste slurry," as it is considered, still comprises a large percentage of useable chemicals and abrasive.

A complicating factor for the process is that the polishing platen is frequently washed with de-ionized (DI) water delivered under pressure to the platen to rinse the platen of slurry between polishing steps. Of course, the DI water mixes with the waste slurry and dilutes the chemical etchants, thereby complicating waste slurry recovery and reuse. Presently, waste slurry, including the waste DI water, is collected from the polishing environment and given minimal processing so as to accommodate environmental concerns. That is, the slurry is processed to separate a majority of the solid particulate material from the liquid and the two by-products, the solids and liquids, are then disposed of by conventional methods. Therefore, considerable waste of the slurry component materials occurs. Also, a large portion of the liquid contains chemicals and increases the liquid volume that must be treated by the municipal water facilities. This larger-than-desired volume of liquid results in a higher-than-necessary bill for services from the municipal water treatment facility. Additionally, the greater usage of chemicals also contributes to increased cost.

Accordingly, what is needed in the art is an apparatus and method of use that efficiently separates waste slurry, including liquids, for recycling or reuse while minimizing liquid volume committed to waste water treatment.

SUMMARY OF THE INVENTION

To address the above-discussed deficiencies of the prior art, the present invention provides a polishing slurry reclamation system. In one embodiment, the polishing slurry reclamation system comprises a polishing apparatus having a polishing platen and a fluid delivery system positioned to deliver a slurry or a rinse to the polishing platen, a recovery drain adjacent the polishing platen, and a fluid diverter associated with the platen and configured to deflect a selected one of either a slurry or a rinse emanating from the polishing platen to the recovery drain.

Thus, in a general sense, the present invention provides a system and method for selectively diverting slurry or rinse water, whichever is currently in use, as it pours over the edge of the polishing platen to a selected recovery drain. Therefore, the user may minimize the volume of slurry and rinse water going into the sanitary sewer. This reduces cost by reducing the volume of waste fluids that is the basis of municipal charges for waste water treatment. The system additionally allows ready recovery of a highly concentrated waste slurry that may be either returned to the manufacturer for recycling or modified for reuse in the polishing process.

In another embodiment, the recovery drain is a slurry drain or a rinse drain. In alternative embodiments, the fluid diverter or polishing platen is selectively positionable to cause the selected one of either the slurry or rinse to be diverted to the recovery drain. In yet another embodiment, the fluid diverter comprises an annular diverter that is concentric about the polishing platen and configured to divert the selected slurry or rinse to the recovery drain when the annular boot is inflated. In a further aspect of this embodiment, the annular diverter may be an inflatable boot or a mechanical diverter.

In another embodiment, the fluid diverter is a fluid shield concentrically and selectively positionable about the polishing platen to divert the selected one of either a slurry or rinse to the recovery drain. In a further aspect of this embodiment, the fluid shield is in a fixed position adjacent the polishing platen.

The fluid diverter, in another embodiment, comprises inert gas nozzles positioned proximate a perimeter of the polishing platen and oriented to route the selected one of either the slurry or rinse to the recovery drain. In a further aspect of this embodiment, the gas nozzles are coupled to a gas nozzle conduit system integrally formed in the polishing platen. In a second aspect of this embodiment, the gas nozzles are adjacent the polishing platen and the system further includes a conduit system external the polishing platen and coupled to the gas nozzles. The conduit system is configured to deliver a gas to the gas nozzles. The gas discharge nozzles, in a third aspect of this embodiment, are connected to an inert gas source.

In another embodiment of the present invention, the fluid diverter is a vacuum system located adjacent the polishing platen and configured to remove slurry from the polishing platen. The vacuum system, in yet another embodiment, further comprises a vacuum system coupled to the recovery drain. The system, in another embodiment, further comprises a filter coupled to the recovery drain.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
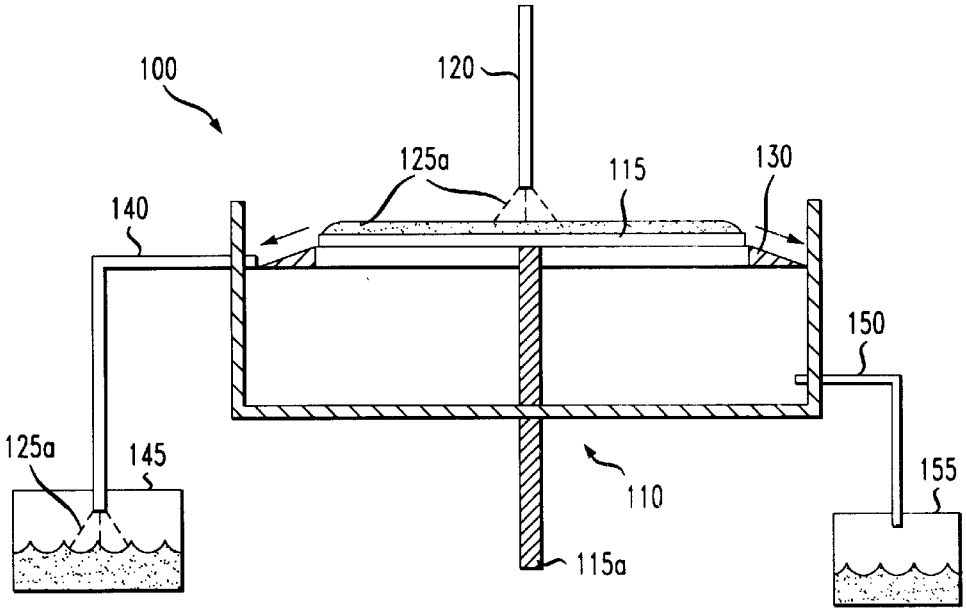
FIG. 1 illustrates a partial sectional view of an advantageous embodiment of a polishing slurry reclamation system constructed according to the principles of the present invention.

Referring now to FIG. 1, illustrated is a partial sectional view of an advantageous embodiment of a polishing slurry reclamation system constructed according to the principles of the present invention. A polishing slurry reclamation system 100 comprises a polishing apparatus 110, a polishing platen and polishing pad, collectively, 115, a platen drive shaft 115*a,* a fluid delivery system 120, a fluid diverter 130, a slurry recovery drain 140, a slurry recovery tank 145, a rinse drain 150, and a rinse recovery tank 155. The fluid delivery system 120 is positionable with respect to the polishing platen 115 to deliver a fluid, collectively 125, that may be either a slurry 125*a* or a rinse 125*b* (See FIG. 2) to the polishing platen 115. One who is skilled in the art is familiar with such fluid delivery systems. The fluid diverter 130, which, in one embodiment, may be likened to a toroidal, concentric fluid shield 130 located about the platen 115, is positioned proximate the polishing platen 115, while the platen 115 is positionable vertically with respect to the fluid diverter 130 by the platen drive shaft 115*a.* The fluid diverter 130 may completely surround the polishing platen 115 or be configured so as to funnel waste slurry 125*a* into a single location that is connected to the slurry drain 140. The slurry drain 140 is connected to the slurry recovery tank 145 that is configured to receive waste slurry 125*a*. In FIG. 1, the platen 115 is positioned vertically so as to direct the used slurry 125*a* from the platen 115, onto the diverter 130, then to the slurry recovery drain 140, and thence to the slurry recovery tank 145.

Figure 2:
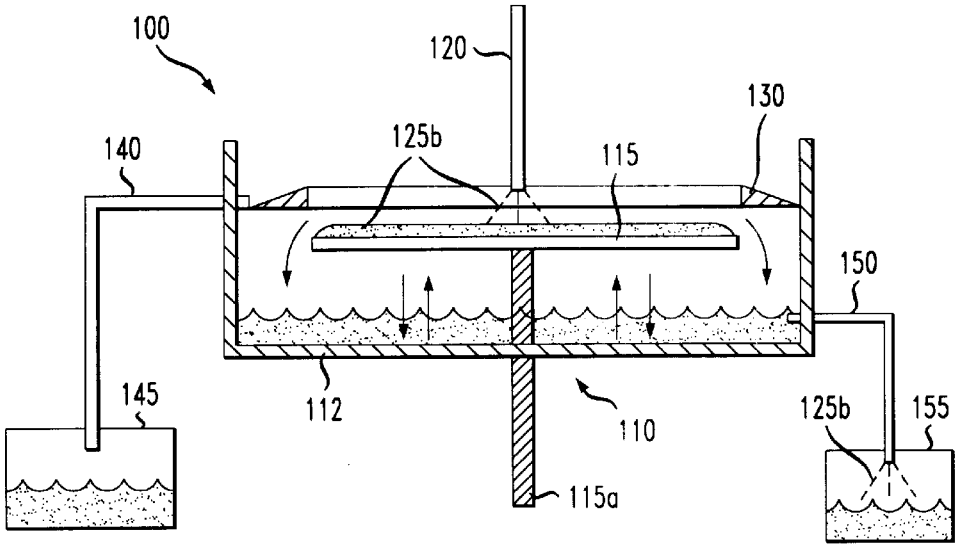
FIG. 2 illustrates the polishing slurry reclamation system of FIG. 1 with the platen vertically positioned so as to recover waste rinse water.

Referring now to FIG. 2, illustrated is the polishing slurry reclamation system of FIG. 1 with the platen 115 vertically positioned so as to recover waste rinse water. In this particular embodiment, the vertical position of the platen 115 may be changed to divert the slurry 125*a* or the rinse 125*b* to their respective tanks. In this position, rinse water 125*b* is directed from the fluid delivery system 120 to the polishing platen 115. The rinse water 125*b* is forced off the platen 115 by centrifugal force from the platen rotation to collect in the bottom of the polishing apparatus 110 that comprises a polishing tank 112. From the polishing tank 112, the rinse water 125*b* is channeled to the rinse recovery tank 155 by the rinse drain 150. Of course, while individual recovery tanks 145, 155 have been shown, they may also be formed as a single recovery tank having separate compartments. Also, it should be noted that the positions of the rinse recovery tank 155 and the slurry recovery tank 145 may be reversed in other embodiments. Of course, one who is skilled in the art will recognize that the slurry recovery drain 140 and rinse drain 150 may alternatively be connected directly to an appropriate recycle/reuse/waste treatment facility or device (not shown).

Figure 3:
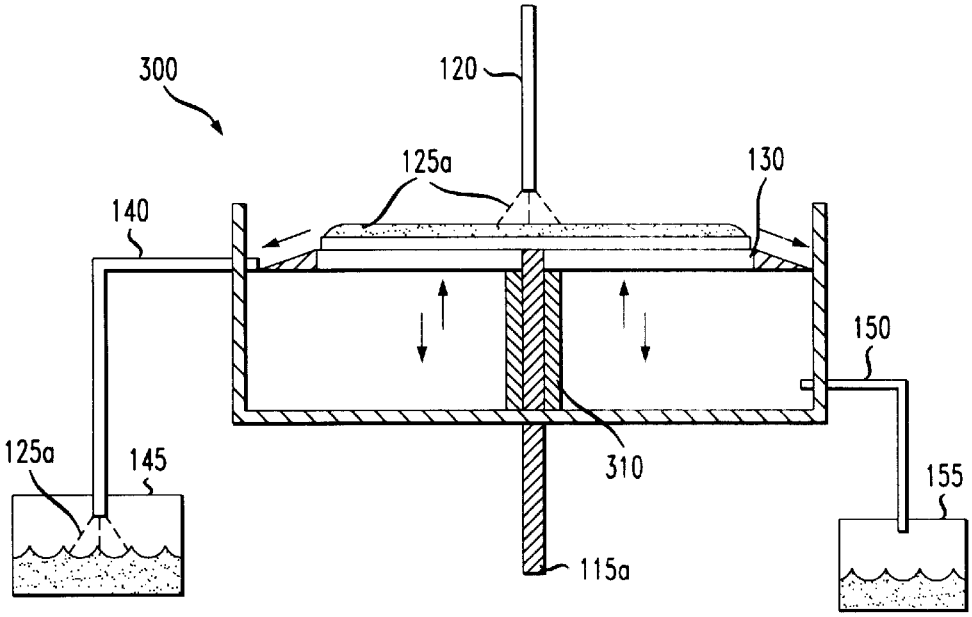
FIG. 3 illustrates a partial sectional view of an alternative embodiment of the polishing slurry reclamation system of FIG. 1.

Referring now to FIG. 3, illustrated is a partial sectional view of an alternative embodiment of the polishing slurry reclamation system of FIG. 1. In this embodiment, a polishing slurry reclamation system 300 further comprises a diverter translation mechanism 310 coupled to the fluid diverter 130. The diverter translation mechanism 310 enables the fluid diverter 130 to be translated vertically. Thus in the illustrated embodiment, the diverter 130 is positioned proximate the platen 115 thereby to direct slurry 125*a* emanating from the platen 115 into the slurry drain 140 and then to the slurry recovery tank 145.

Figure 4:
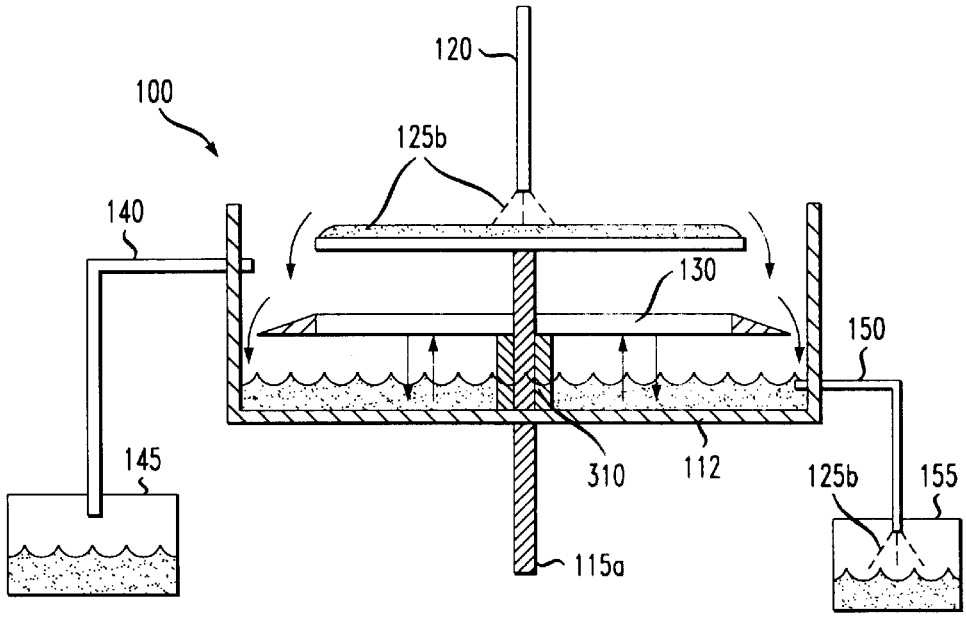
FIG. 4 illustrates the polishing slurry reclamation system of FIG. 3 with the fluid diverter positioned to recover waste rinse water.

Referring now to FIG. 4, illustrated is the polishing slurry reclamation system of FIG. 3 with the fluid diverter 130 positioned to recover waste rinse water 125*b*. To collect waste rinse water 125*b,* the fluid diverter 130 is translated vertically downward by the diverter translation mechanism 310. In this position, waste rinse water 125*b* emanating from the platen 115 cascades onto the diverter 130 and then to the polishing tank 112, into the rinse drain 150, and then into the rinse recovery tank 155.

Figure 5:
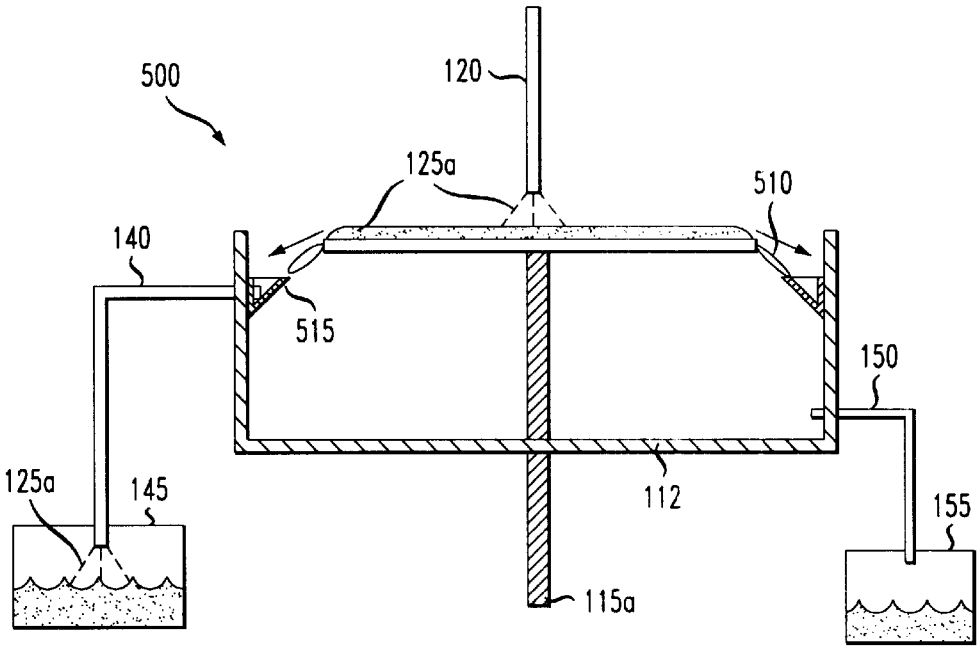
FIG. 5 illustrates an elevational view of a second alternative embodiment of the polishing slurry reclamation system of FIG. 1.
Figure 6:
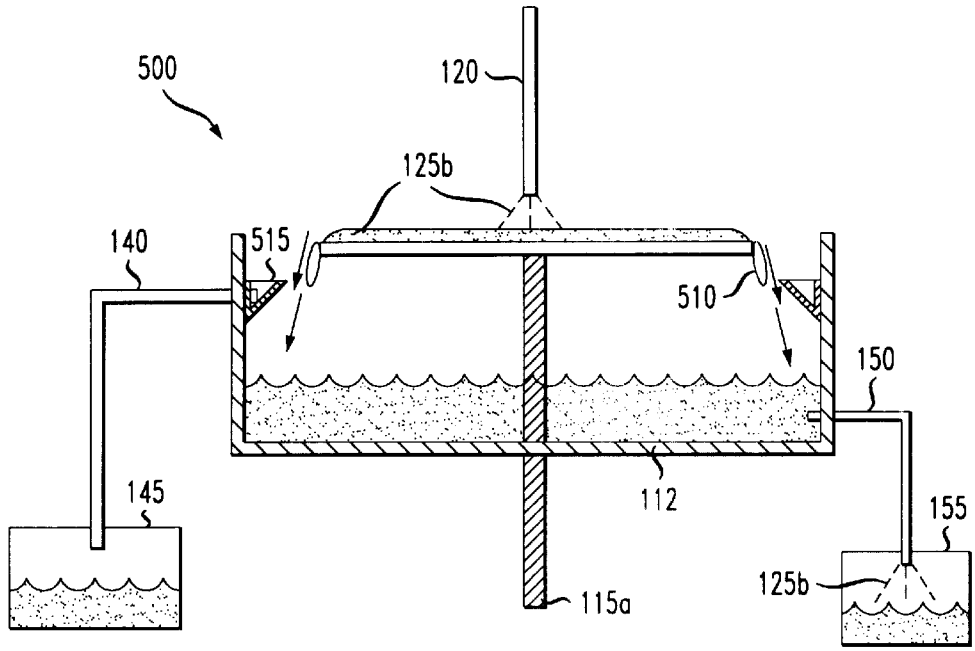
FIG. 6 illustrates the polishing slurry reclamation system of FIG. 5 with the fluid diverter positioned to recover waste rinse water.

Referring now to FIGS. 5 and 6, illustrated are elevational views of a second alternative embodiment 500 of the polishing slurry reclamation system of FIG. 1. In this embodiment, a polishing slurry reclamation system 500 further comprises an inflatable annular boot 510 and a concentric receptacle 515. Both the inflatable annular boot 510 and the concentric receptacle 515 are concentric about the polishing platen 115. The inflatable annular boot 510 may be inflated as shown in FIG. 5 thereby channeling the slurry 125*a* into the concentric receptacle 515, the slurry drain 140 and the slurry recovery tank 145. The inflatable annular boot 510 may likewise be deflated as shown in FIG. 6, thereby allowing the rinse water 125*b* to cascade over the inflatable annular boot 510 and down into the polishing tank 110. Further recovery is as described above. Alternatively, one who is skilled in the art will readily understand that the annular boot 510 need not be inflatable but may rather be a mechanical diverter. In such an embodiment, the annular boot 510 may be positioned by a mechanical apparatus such as a drive motor (not shown) or pneudralic system between positions for slurry recovery (FIG. 5) and rinse recovery (FIG. 6).

Figure 7:
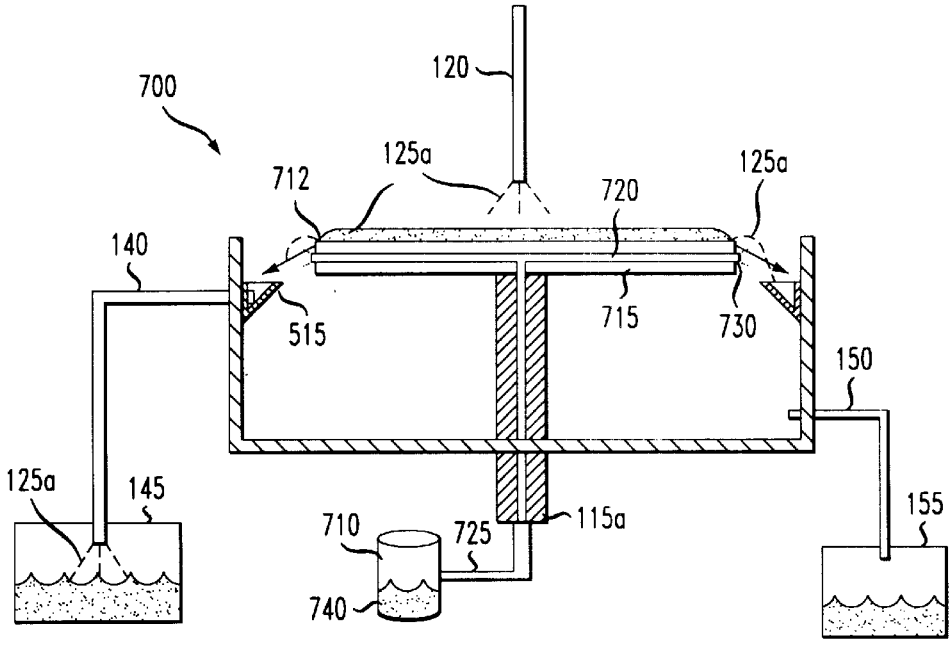
FIG. 7 illustrates an elevational view of an alternative embodiment of the polishing slurry reclamation system of FIG. 5.
Figure 8:
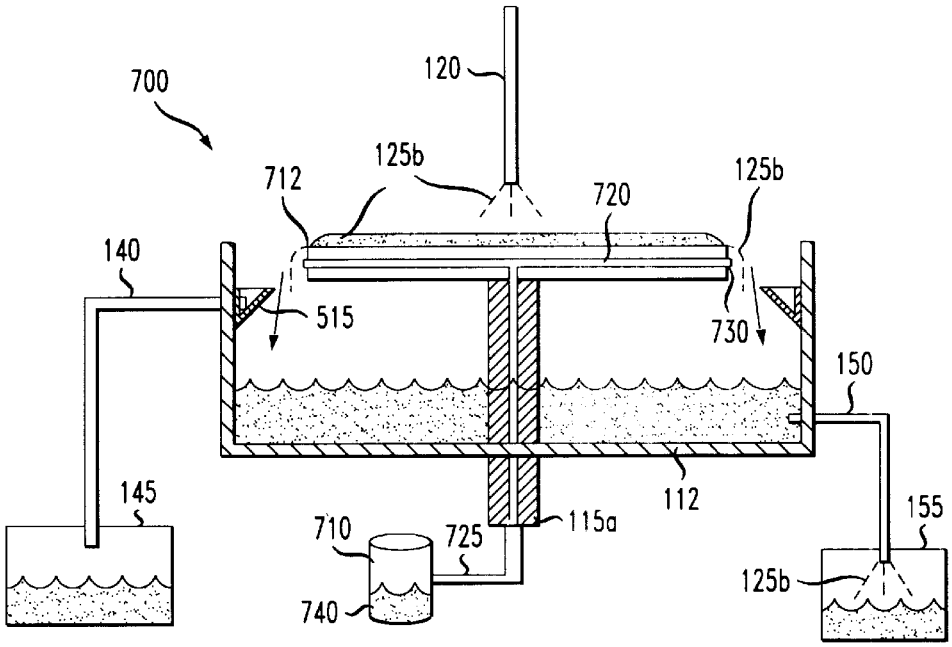
FIG. 8 illustrates the polishing slurry reclamation system of FIG. 7 with the fluid diverter positioned to recover waste rinse water.

Referring now to FIGS. 7 and 8, illustrated are elevational views of an alternative embodiment of the polishing slurry reclamation system of FIG. 5. In this embodiment, a polishing slurry reclamation system 700 further comprises a gas supply system 710, a platen 715 that may be customized to incorporate a gas distribution system 720, a conduit system 725, gas nozzles 730, and a gas 740. The gas nozzles 730 are positioned proximate an edge 712 of the polishing platen 715 and are oriented to route the waste slurry 125*a* to the slurry drain 140. Of course, the system may also be configured to use the gas supply and distribution systems 710, 720 to route waste rinse 125*b* to an appropriately configured rinse drain 150. The gas distribution system 720 conducts the inert gas 740 from the inert gas supply 710 through the conduit system external the polishing platen to the gas nozzles 730 that may be integrally formed or coupled to the polishing platen 715. That is, the gas supply system 710, through the conduit system 725 and the gas nozzles 730, blows the inert gas 740 toward the concentric receptacle 515. The inert gas 740 carries the waste slurry 125*a* with the gas 740 into the concentric receptacle 515. As shown in FIG. 8, the gas supply system 710 is turned off, and the waste rinse water 125*b* cascades from the platen edge 712 into the polishing tank 112 to be recovered in the waste rinse tank 155.

Figure 9:
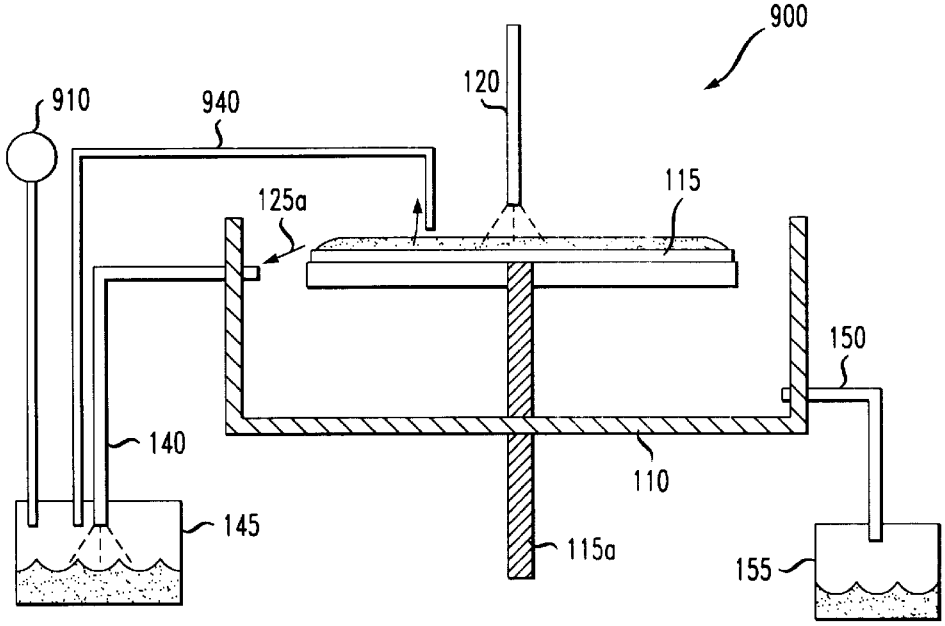
FIG. 9 illustrates a partial sectional view of an another alternative embodiment of the polishing slurry reclamation system of FIG. 1.

Referring now to FIG. 9, illustrated is a partial sectional view of an alternative embodiment of the polishing slurry reclamation system of FIG. 1. In this embodiment, a polishing slurry reclamation system 900 comprises a vacuum system 910 coupled to the recovery drain 140 through the waste slurry tank 145. This allows the waste slurry tank 145 to be evacuated and the vacuum thereby created assists in the removal of slurry 125*a* to the slurry recovery tank 145. Slurry 125*a* may be drawn through the recovery drain 140 proximate the platen 115, or through an optional slurry conduit 940 positioned over the slurry 125*a* on the platen 115. Of course, similar connections may also be made to the rinse tank 155 to use vacuum assist to remove rinse water.

Figure 10:
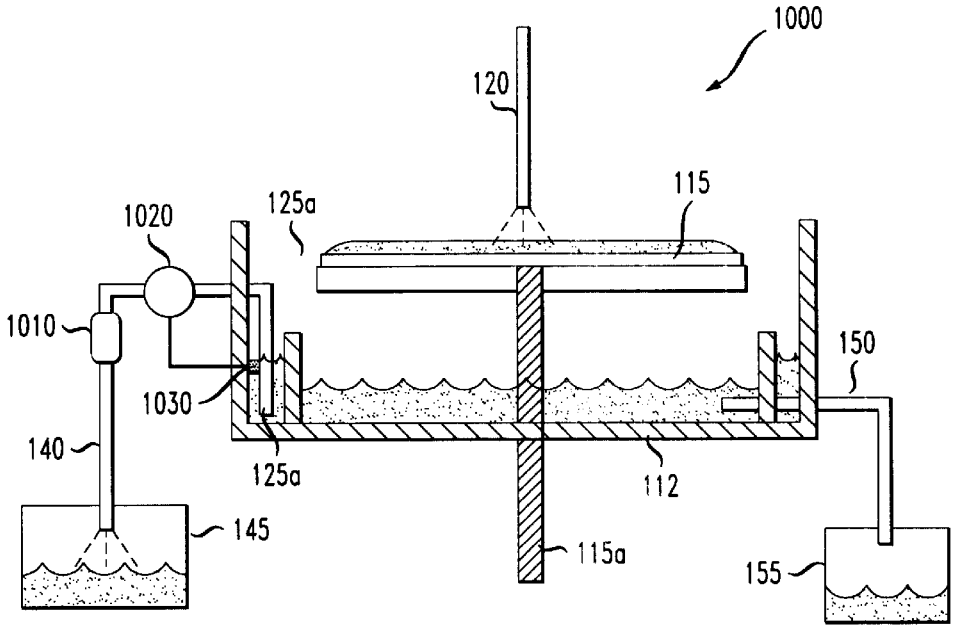
FIG. 10 illustrates a partial sectional view of an alternative embodiment of the polishing slurry reclamation system of FIG. 9.

Referring now to FIG. 10, illustrated is a partial sectional view of an alternative embodiment of the polishing slurry reclamation system of FIG. 9. In this embodiment, a polishing slurry reclamation system 1000 further comprises a filter 1010 and a pump 1020 coupled to the recovery drain 140 through the waste slurry tank 145. The filter 1010 assists in separating solid particles of the slurry 125*a* before the slurry recovery tank 145. This embodiment may also incorporate a slurry level sensor 1030 that energizes the pump 1020 when a level of the slurry 125*a* is sufficient to prevent the pump 1020 from running dry.

Thus, several embodiments of a polishing slurry reclamation system have been described that incorporate a diverter of various forms to permit selectively routing waste slurry or waste rinse water to recovery tanks from whence the products can be recycled. Although the present invention has been described in detail, those skilled in the art should understand that they can make various changes, substitutions and alterations herein without departing from the spirit and scope of the invention in its broadest form.

What is claimed is:

1. A polishing slurry reclamation system, comprising:

a polishing apparatus having a polishing platen and a fluid delivery system positioned to selectively deliver one of a slurry and a rinse to the polishing platen;

a slurry recovery drain and a rinse recovery drain adjacent the polishing platen; and a fluid diverter concentric with and adjacent to the platen, wherein the polishing platen is selectively positionable relative to the fluid diverter to cause the selected one of the slurry and the rinse to be diverted to a selected corresponding one of the slurry recovery drain and the rinse recovery drain.

2. The system as recited in claim 1 wherein the polishing platen can translate vertically with respect to the fluid diverter.

3. A polishing slurry reclamation system, comprising:

a polishing apparatus having a polishing platen and a fluid delivery system positioned to selectively deliver one of a slurry and a rinse to the polishing platen;

a slurry recovery drain and a rinse recovery drain adjacent the polishing platen; and an annular, inflatable boot adjacent to and concentric about the polishing platen and configured to divert the selected one of the slurry and the rinse emanating from the polishing platen to a selected corresponding one of the slurry recovery drain and the rinse recovery drain.

4. A polishing slurry reclamation system, comprising:

a polishing apparatus having a polishing platen and a fluid delivery system positioned to deliver a slurry or a rinse to the polishing platen;

a recovery drain adjacent the polishing platen; and a fluid diverter comprising gas nozzles positioned proximate a perimeter of the polishing platen and oriented to route a selected one of a slurry or rinse emanating from the polishing platen to the recovery drain.

5. The system as recited in claim 4 wherein the gas nozzles are coupled to a gas nozzle conduit system integrally formed in the polishing platen.

6. The system as recited in claim 4 wherein the gas nozzles are adjacent the polishing platen and the system further includes a conduit system external the polishing platen coupled to the gas nozzles and configured to deliver a gas to the gas nozzles.

7. The system as recited in claim 4 wherein the gas discharge nozzles are connected to an inert gas source.

* * * * *